US005473801A

United States Patent [19]

Straube et al.

[11] Patent Number: 5,473,801

[45] Date of Patent: Dec. 12, 1995

[54] WIRE CARD NAPPING MACHINE

[75] Inventors: Volker Straube, Loessnitz; Gotthard Schaedlich, Aue, Sachsen; Lothar Fankhaenel, Zwoenitz; Dieter Seidel, Schneeberg, all of Germany

[73] Assignee: Textilmaschinenbau Aue GmbH, Sachsen, Germany

[21] Appl. No.: 50,472

[22] PCT Filed: Jan. 16, 1992

[86] PCT No.: PCT/DE92/00020

§ 371 Date: Aug. 11, 1993

§ 102(e) Date: Aug. 11, 1993

[87] PCT Pub. No.: WO92/14878

PCT Pub. Date: Sep. 3, 1992

[30] Foreign Application Priority Data

Feb. 21, 1991 [DE] Germany ..... 41 05 391.5

[51] Int. Cl.[6] ..... D06C 11/00

[52] U.S. Cl. ..... 26/33; 26/32

[58] Field of Search ..... 26/31, 32, 33, 26/35, 34, 36, 29 R

[56] References Cited

U.S. PATENT DOCUMENTS

| | | | |
|---|---|---|---|
| 11,612 | 6/1897 | Grosselin | 26/34 |
| RE 13,695 | 3/1914 | Greene | 26/33 |
| 358,136 | 2/1887 | Woelfel | 26/34 |
| 662,589 | 11/1900 | Borchers | 26/33 |
| 2,884,678 | 5/1959 | Hadley | 26/34 |
| 3,174,205 | 3/1965 | Bertrand | 26/33 |
| 3,175,224 | 3/1965 | Bertrand | 26/33 |
| 4,073,043 | 2/1978 | Lowder | 26/33 |

FOREIGN PATENT DOCUMENTS

| | | | |
|---|---|---|---|
| 102087 | 7/1898 | Germany | 26/33 |
| 281288 | 1/1913 | Germany | 26/33 |
| 286738 | 9/1913 | Germany | 26/33 |
| 401721 | 9/1924 | Germany . | |
| 3307881 | 9/1984 | Germany . | |
| 2222837 | 3/1990 | United Kingdom . | |

*Primary Examiner*—C. D. Crowder
*Assistant Examiner*—Amy B. Vanatta
*Attorney, Agent, or Firm*—Jordan and Hamburg

[57] ABSTRACT

The wire card napping machine has at least one driven cylinder, with several pick-up devices, each of which is equipped with at least one napping roller of a different roller type and is embedded in the side disks of the cylinder, it being possible to rotate at least one pick-up device by means of an adjusting device. The adjusting device has a lifting device, which can be operated in a controlled manner and to which a segment bearer, which can be moved by the lifting device between a starting position and an operating position, which brings about a pick-up device that is to be rotated in a defined angle, is connected in hinged fashion and the segment bearer lies in its operating position against a wheel, which is disposed firmly at the pick-up device that is to be rotated. The adjusting device has assigned to it an unlocking device, which has a further lifting device, which can be operated in a controlled manner, to which an unlocking segment, which can be moved by the further lifting device between a starting position and an operating position, which brings about the unlocking of the pick-up device that is to be rotated through a defined angle, is connected in hinged fashion. The unlocking segment, in its operating position, is connected in hinged fashion to a locking device, which is disposed at a pick-up device that is to be rotated, before the pick-up device in question is rotated to bring about the unlocking.

12 Claims, 4 Drawing Sheets

WIRE CARD NAPPING MACHINE

BACKGROUND OF THE INVENTION

The invention relates to a wire card napping machine for fabrics with at least one driven cylinder, several rotatable and lockable pick-up devices each of which is equipped with at least one napping roller of a different roller type and is embedded in the side disks of the cylinder.

The surface of the textile fabric is napped (napping effect) by the wire card napping machine using a differential speed between the textile fabric to be napped and the napping rollers. As a result of such napping, an increased heat-holding capacity and a wooly, fleecy handle are attained. To achieve napping effects, napping rollers of the same roller type (counter-pile rollers or pile rollers) or napping rollers of different roller types (counter-pile rollers and pile rollers in the same or different ratio to one another) are used. Moreover, the possibility also exists of using different card clothings for the napping rollers.

A wire card napping machine with several revolve-shaped pick-up devices embedded in side disks of a cylinder has been proposed (German patent No. 401,721). Each pick-up device is equipped with several napping elements in such a manner, that only one napping element of each pick-up device is in the working position and that the textile fabric is napped first with a blunt and then, corresponding to the progressing operating cycle, with a sharper card clothing.

Due to a cogwheel driving mechanism, which is appropriately connected with the pick-up devices, only the possibility exists of adjusting all pick-up devices jointly in such a manner that, after the adjustment, the textile fabric can be napped once again first with a blunt and then, corresponding to the progressing operating cycle, with a shaper card clothing.

SUMMARY

It is an object of the invention to overcome the drawbacks of the prior art. In the wire card napping machine of the present invention, the ratio of one type of napping rollers to another type of napping rollers can be changed by at least one unlocking, adjusting and locking device.

The adjusting device of the present invention has a lifting device that can be operated in a controlled manner.

A segment bearer, which can be moved by the lifting device between a starting position and an operating position, which brings about a pick-up device that is to be rotated in a defined angle, is connected in hinged fashion.

The segment bearer lies in its operating position against a wheel, which is disposed firmly at the pick-up device that is to be rotated.

The adjusting device has assigned to it an unlocking device, which has a second lifting device, which can be operated in a controlled manner.

An unlocking segment, connected in hinged fashion can be moved by the second lifting device between a starting position and an operating position, which brings about the unlocking of the pick-up device that is to be rotated through a defined angle.

The unlocking segment, in its operating position, is connected in hinged fashion to a locking device disposed at a pick-up device that is to be rotated before the pick-up device in question is rotated to bring about the unlocking.

The advantages achieved by the invention are seen to lie essentially in that the ratio of the one to the other type of napping rollers in the operating position can be changed. This is understood to include also such a ratio, for which the napping rollers of only one type of roller are in the operating position. As a result, other napping effects can be achieved. In this connection, it is also essential that the textile fabric, during the change in the ratio of the one to the other type of napping roller in the operating position, can remain on the cylinder and relatively long retooling times are avoided.

DETAILED DESCRIPTION OF THE PREFERRED EMBODIMENT

Figure 1:
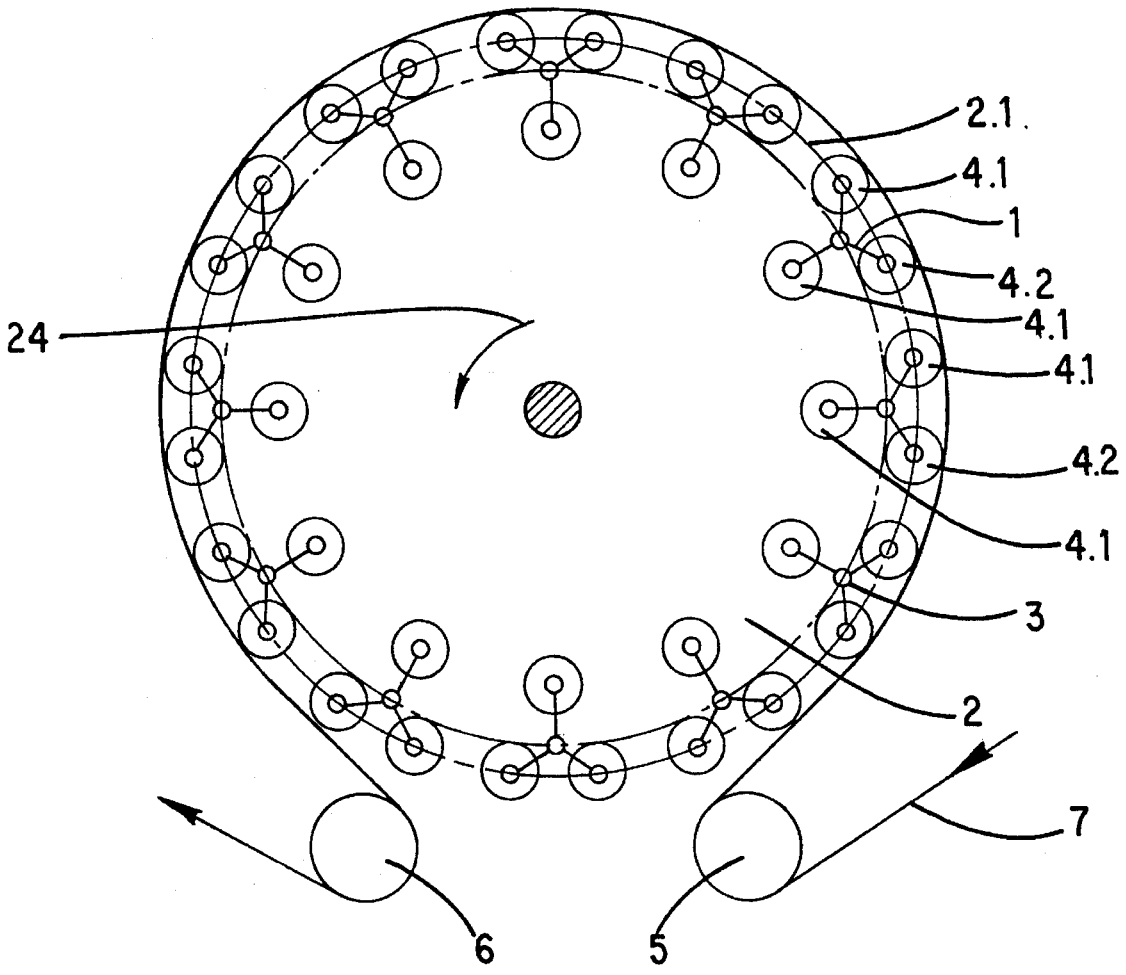
FIG. 1 shows a diagrammatic cross-sectional representation of a cylinder of a wire card napping machine with an equal number of counter-pile rollers and pile rollers in the operating position, as well as two drawing rollers assigned to the cylinder.

One of the features of the wire card napping machine is a driven cylinder, which is mounted in a machine frame that is not shown. Essentially several pick-up devices 1, are mounted by ends in bearings 3 disposed on the cylinder disks 2, so that they can be rotated and locked, belong to this cylinder. For reasons of clarity, FIG. 1 shows only one cylinder disk 2.

Each pick-up device 1 is equipped with two types of napping rollers 4.1, 4.2 namely, according to an embodiment, with two counter-pile napping rollers 4.1—referred to hereinafter also as G—and one pile napping roller 4.2—referred to hereinafter also as S—the napping rollers 4.1, 4.2 on the arc of the circle 2.1 being in the operating position. For reasons of clarity, only two pick-up devices 1 and the types of napping rollers 4.1, 4.2 mounted therein are labeled with the appropriate reference numbers.

The napping rollers 4.1, 4.2 are mounted at each end on bearings in the pick-up devices 1, preferably only the napping rollers 4.1, 4.2 which are in the operating position, being driven.

As will still be described in the following, the pick-up devices 1, mounted on bearings in the cylinder disk 2, are locked in their starting position. They can be unlocked and thereafter turned through an angle corresponding to the division of the napping rollers 4.1, 4.2 in the pick-up device 1 and then locked once again in their new position. By these means, it is possible to change the ratio of the counter-pile napping rollers 4.1 to the pile napping rollers 4.2 that are in the operating position. For example, the following variations in the ratio of the napping rollers 4.1, 4.2 in the operating position are preferably used.

| | Ratio of G to S | Repeating Sequence of Two Concsecutive Pick-up Devices 1 |
|---|---|---|
| Figure 1 | 1:1 | G - S - G - S - . . . |
| after rotating all pick-up devices 1 by 120° relative to FIG. 1 by 24 napping rollers 4.1, 4.2 in the operating position | 24:0 (G:O) | G - G - G - G - . . . |
| after rotating each second pick-up device 1 by a further 120° | 3:1 | G - G - S - G - . . . |

The wire card napping machine also includes an inlet drawing roller 5 and an outlet drawing roller 6, both of which are mounted in the machine frame and with which the textile fabric 7, running over the cylinder, is transported and, at the same time, held under a certain tension. Further elements belonging to the wire card napping machine, such as the driving mechanism, the inlet and outlet of the wire card napping machine and the stripping rollers, are not shown for clarity.

Figure 2:
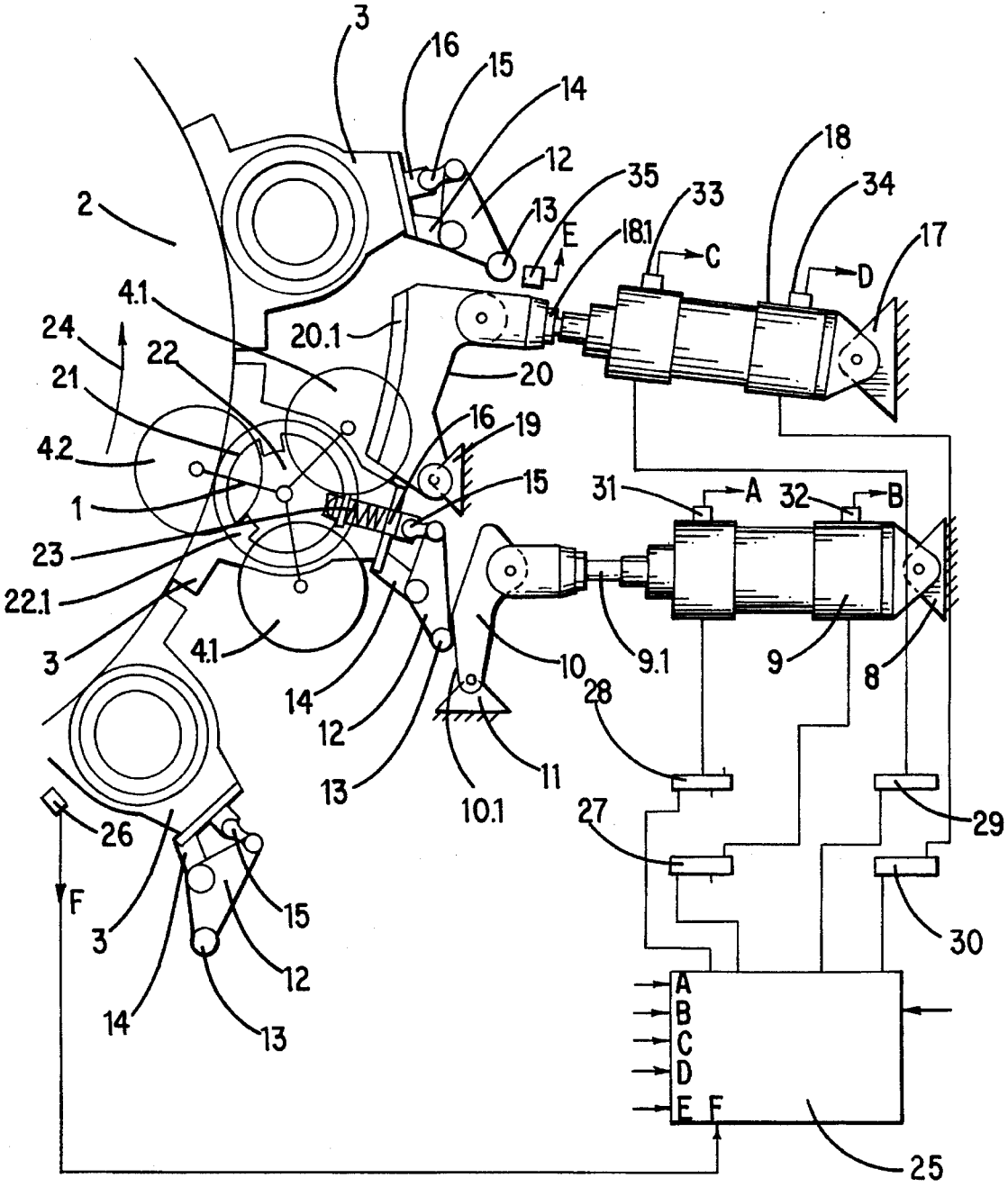
FIG. 2 shows a diagrammatic representation of an unlocking, adjusting and locking device, the unlocking process being initiated at a defined pick-up device.
Figure 3:
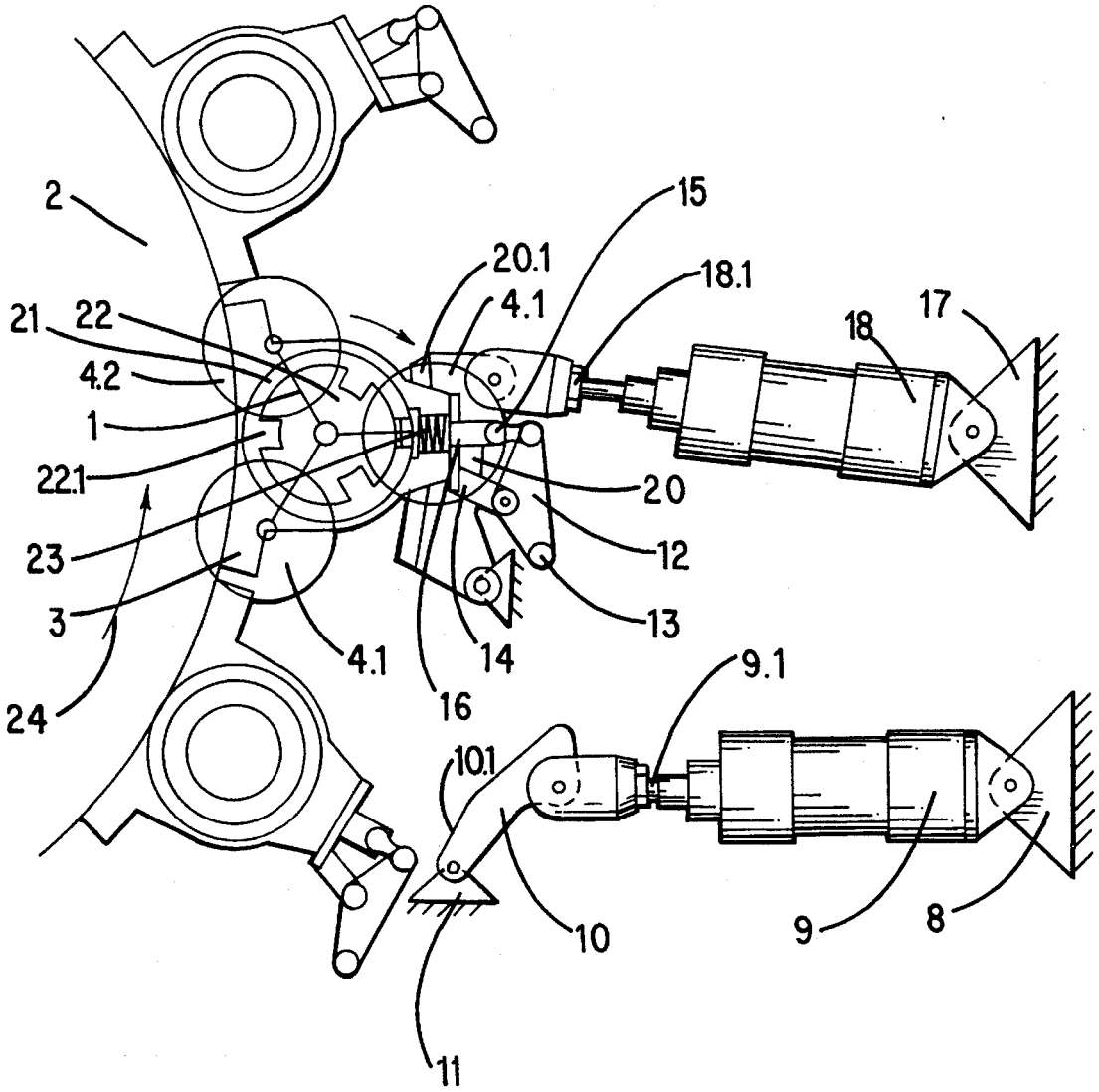
FIG. 3 shows a diagrammatic representation of the unlocking, adjusting and locking device during the adjusting process of the defined pick-up device.

Referring to FIGS. 2 and 3, in order to attain the ratio of the one type of napping roller 4.1 to the other type of napping roller 4.2 in the operating position, an unlocking device, an adjusting device and a locking device, are provided. FIG. 2 shows the unlocking device in its operating position, that is, in a position, in which the unlocking process has already been initiated for a defined pick-up device 1.

The unlocking device has a working cylinder 9, which is preferably pivotably mounted in a seat 8 present in the machine frame and a winding element 10, which is coupled to the piston rod 9.1 of this working cylinder 9 and is pivotably mounted in a bearing 11, which is also preferably disposed in the machine frame. The side of the winding element 10, pointing to the cylinder disk 2, is constructed a winding curve 10.1, along which a roller 13, mounted on an unlocking lever 12, rolls down during the unlocking of the pick-up device in question. The unlocking lever 12 is supported in a seat 14, which preferably is fastened at the bearing 3, which is coupled by a tension element 15 to a locking pin 16.

The adjusting device, which serves to rotate the pick-up device 1, has a second working cylinder 18, which is supported in a bearing 17 disposed in the machine frame. Linked to the piston rod 18.1 of this second working cylinder 18, is a segment bearer 20, which is mounted in a bearing 19 disposed in the machine frame. This segment bearer 20 is equipped with a rubbing or friction segment 20.1 which, in the event that the pick-up device 1 rotates, is connected with a friction disk 21 firmly disposed preferably on a bearing pin of the pick-up device 1.

The locking device has a locking disk 22 with recesses 22.1, firmly connected to the pick-up device 1. In the locked state, the locking pin 16, biased by a compression spring 23 and coupled through a tension element 15 to the unlocking lever 12, protrudes into one of the recesses 22.1. Thus, locking pin 16 fixes the position of the pickup device 1.

In FIGS. 2 and 3, only one unlocking device, one adjusting device and one locking device are shown. The unlocking device and the adjusting device are supported at a defined place in the machine frame and in the region of a cylinder disk 2 in such a manner that, in the event of a change in the ratio of the napping rollers 4.1, 4.2 of the one type of roller to the other type of roller in the operating position, the unlocking device and the adjusting device act on the defined pick-up device 1. A second unlocking, adjusting device (not shown) is also supported at a defined place in the machine frame and in the region of the other cylinder disk 2 (not shown) in such a manner that, simultaneously with the other unlocking device and adjusting device, it brings about an adjustment (unlocking, rotating by a defined angle and renewed locking) of the pick-up device 1 in question.

It is, however, also possible to support a further pair of unlocking and adjusting devices at a further defined place in the machine frame in order thus to be able to adjust a further pick-up device 1.

The locking devices are present at both ends of all pick-up devices 1.

The inventive unlocking, adjusting and locking device works in the following way. Referring to FIG. 2, the course of a change-over of a pick-up device 1 is specified by a memory-storable control system 25. To determine the position of the cylinder, an absolute angle transmitter 26, which is connected to the memory-programmed control system 25, is assigned to the cylinder. With the transmitter 26, it is possible to identify accurately the position of each take-up device 1 with respect to the absolute angle of rotation $\alpha$ of the cylinder disks 2 and, of the cylinder. Within the memory-programmable control system 25, a reference quantity, such as a number, is assigned to each pick-up device 1. Likewise, the existing ratio of counter-pile napping rollers 4.1 to the pile napping rollers 4.2 and, the position of rotation of each pick-up device 1 is stored in the memory-programmable control system 25.

If the ratio of counter-pile napping rollers 4.1 to pile napping rollers 4.2 is changed, the operator selects the desired ratio of counter-pile napping rollers 4.1 to pile napping rollers 4.2, enters this data into the memory-programmable control system 25 and starts the latter and, with that, the change-over of the corresponding pick-up devices 1. At the same time, the memory-programmable control system 25 defines the pick-up devices to be changed over from the existing and the desired ratio of the counter-pile napping rollers 4.1 to the pile napping rollers 4.2. Moreover, for certain pick-up devices 1, a double change-over and, preferably a further cylinder revolution may be necessary. The magnetic valves 27, 28 for the first working cylinder 9 and the magnetic valves 29, 30 for the second working cylinder 18 are driven directly as a function of the absolute angle of rotation of the cylinder, the respective position of the working cylinders 9, 18 being checked by sensors 31, 32, 33, 34. A further sensor 35 checks the locking of this pick-up device 1, which is accomplished after the change-over of the first pick-up device 1 by the locking pin 16 in conjunction with the locking disk 22.

In the event of a change in the ratio of the counterpile napping rollers 4.1 to the pile napping rollers 4.2, the first working cylinder 9, commencing with the defined first pick-up device 1 and commencing from the starting position—this starting position corresponds to the absolute angle of rotation $\alpha_1$—of the pick-up device 1, is acted upon with a pressure medium, so that the piston rod 9.1 and, the winding element 10 move into the operating position shown in FIG. 2. The rotational movement of the cylinder—shown in FIGS. 1 to 3 by an arrow 24 effects the change in the ratio of counter-pile napping rollers 4.1 to pile napping rollers 4.2. The rotational speed of the cylinder preferably is relatively low during the operation. The roller 13 rolls along the winding curve 10.1 in the first phase, so that the unlocking lever 12, mounted in the seat 14, lifts the locking pin 16 over the tension element 15 and, with that, the pick-up device 1 is unlocked. When the angle of rotation $\alpha_2$ is reached, the second working cylinder 18 is acted upon by a pressure medium, to extend the piston rod 18.1 to move the segment bearer 20 into its operating position, so that the friction segment 20.1 lies against the friction disk 21. The rotational movement of the cylinder rotates the friction disk 21 along the friction segment 20.1 and, thus turns the pick-up device 1 until an angle of rotation $\alpha_4$ is reached. When the angle of rotation $\alpha_3$ is reached, which lies between the angles of rotation $\alpha_2$ and $\alpha_4$, the first working cylinder 9 is actuated in the opposite direction, to place the working cylinder 9 at its starting position once again, as shown in FIG. 3.

When the angle of rotation $\alpha_4$ is reached, the defined pick-up device 1 has completed a rotational movement of 120°. A recess 22.1, present in the locking disk 22, is placed in a position wherein the locking pin 16 engages the recess 22.1 due to the force of the compression spring 23. Thus, the defined pick-up device 1 is shifted by an angle of rotation of 120° and locked once again. Accordingly a napping roller 4.1, 4.2, which previously was in the working position, now is outside its working position, while the napping roller 4.1, 4.2, which previously was outside of the working position, now is on the arc of a circle 2.1 and in the working position.

Likewise, with the reaching of the angle of rotation $\alpha_4$, the second working cylinder 18 is acted upon in the opposite direction by the pressure medium, so that the second working cylinder 18 and, the segment bearer 20 are moved back into their starting position.

When the cylinder is in the region of its angle of rotation $\alpha_5$, the locking of the previously rotated pick-up device 1 is checked by means of a sensor 35.

Figure 4:
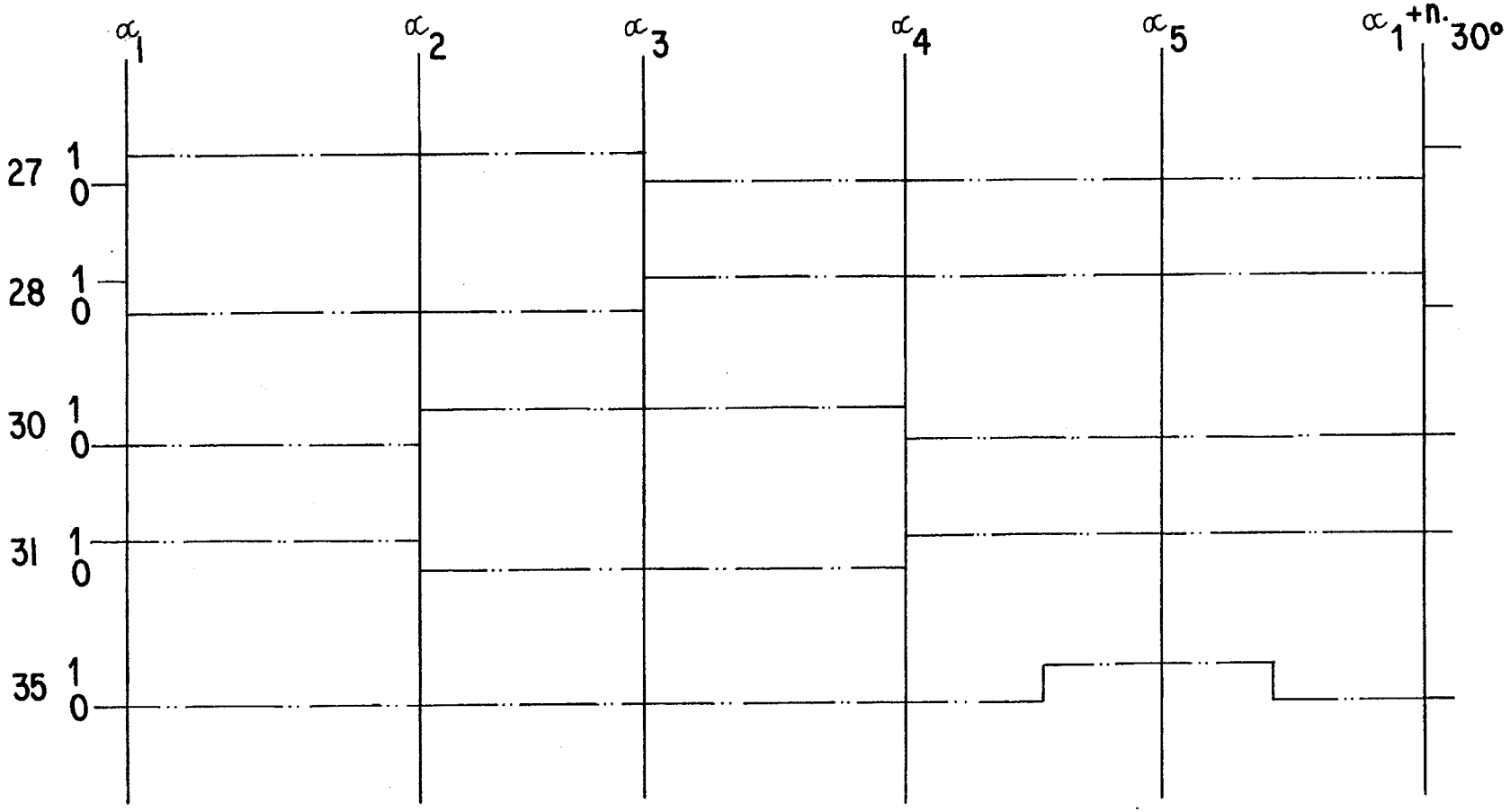
FIG. 4 is a time-lapse plan for unlocking, adjusting and locking a pick-up device.

The processes of unlocking, rotating and locking a pick-up device are shown in FIG. 4 as a function of the angle of rotation $\alpha$. The processes described also take place at the same time and in the same cycle for the unlocking, adjusting and locking device at the other end of the defined pick-up device 1.

When the unlocking, adjusting and locking process is finished completely for a pick-up device 1, the cylinder rotates further until a pre-selected pick-up device 1—labeled "n" in FIG. 4—is in the defined position, that is, in the position required for unlocking, rotating and locking. Upon reaching this position, the unlocking, rotating and renewed locking of the pre-selected pick-up device 1 in question take place, as already described and shown in FIGS. 2 to 4. This process is repeated in accordance with the input into the memory-programmable control system 25 by the operating personnel.

The 30° magnitude of the angle, given in FIG. 4, is derived from the number of pick-up devices 1 mounted in the cylinder; in the present example: 360° divided by 12 pick-up devices 1=30° per pick-up device. For the selection of the pick-up devices 1 to be adjusted, it is, however, also possible to specify a different angle, such as 60°, 90°, etc., to the memory-controllable control system 25.

If, for example, there are fifteen pick-up devices 1 on the cylinder, an angle of 24° results, which is specified to the memory-programmable control system 25 as a parameter.

The control elements indicated in FIG. 2, such as the angle transmitters 26, magnetic valves 27, 28, 29, 30, sensors 31, 32, 33, 34, 35 and the memory programmable control system 25 have not been drawn in FIG. 3 for reasons of clarity. This also applies correspondingly to the labeling of the pick-up devices 1 that lie outside of the unlocking, adjusting and locking region.

The present invention is used in wire card napping machines, as used in the textile finishing industry for finishing textile fabrics 7. Such a wire card napping machine has at least one driven cylinder. In the side disks 2 of the cylinder, several rotatable and lockable pick-up devices 1 are mounted, each of which is equipped with at least one napping roller of a different roller type.

The advantages, achieved by the invention, can be seen to lie essentially in that the ratio of the napping rollers of the one roller type to the other roller type, which are in the operating position, can be varied. This is understood to include also such a ratio, in which napping rollers of only one type of roller are in the working position and as a result of which other napping effects can be achieved. In this connection, it is also important that the textile fabric, during the change in the ratio of the napping rollers of the one type of roller to the other type of roller, which are in the working position, can remain on the cylinder and relatively long resetting times can thus be avoided.

We claim:

1. A wire card napping machine for fabrics comprising:

at least one driven cylinder rotatably supported in a machine frame and having first and second side disks;

pick-up devices supported by said first and second side disks;

each of said pick-up devices having at least one napping roller of a first type;

at least one of said pick-up devices having a napping roller of a second type in addition to a napping roller of said first type;

said one pick-up device including means for rotatably supporting said one pick-up device on said first and second side disks;

an adjusting device having a first lifting device, a segment bearer movably supported by said first lifting device permitting transport of said segment bearer between a starting position and an operating position for engaging and rotating said one pick-up device through a defined angle;

a disk fixed to said one pick-up device and disposed to functionally engage said segment bearer, at said operating position, to effect rotation of said one pick-up device through said defined angle as said cylinder rotates;

said adjusting device having an unlocking device including a second lifting device;

an unlocking segment movably supported by the second lifting device to permit travel between a starting position and an operating position to effect unlocking of said one pick-up device for the purpose of said rotation through said defined angle; and said one pick-up device including a locking device for preventing rotation of said one pickup device;

said locking device having means for movably supporting said locking device to permit movement between a first position whereat said locking device prevents rotation of said one pick-up device and an operating position whereat said locking device permits rotation of said one pick-up device;

said locking device and said unlocking segment being engageably disposed when said unlocking segment is at said operating position thereof to effect displacement of said locking device to said operating position thereof as said cylinder rotates to accomplish unlocking prior to said rotation of said one pick-up device by said segment bearer; and means for controlling said first and second lifting devices.

2. The wire card napping machine of claim 1, wherein said means for controlling includes means for operating the first lifting device in response to operation of the second lifting device.

3. The wire card napping machine of claim 1, wherein said means for controlling includes means for operating the first lifting device at times staggered from operation of the second lifting device.

4. The wire card napping machine of claim 1, wherein the segment bearer, at its operating position, is connected non-positively with the disk.

5. The wire card napping machine of claim 1, wherein the segment bearer, at its operating position, is connected positively with the disk.

6. The wire card napping machine of claim 1, wherein the adjusting device and the unlocking device are disposed proximate one of a first and a second end of said one pick-up device in the machine frame.

7. The wire card napping machine of claim 1, further comprising said locking device having a locking pin for engaging and locking said one pick-up device and a force transfer element disposed to the unlocking segment and displace the locking pin.

8. The wire card napping machine of claim 1, further comprising:

a means for sensing an absolute angle ($\alpha$) of said cylinder;

said means for controlling being responsive to the absolute angle ($\alpha$) of the cylinder to effect operation of the unlocking device and the adjusting device.

9. The wire card napping machine of claim 8, wherein the control system has a memory-programmable control unit.

10. The wire card napping machine of claim 9, further comprising at least one scanning element for detecting a position of at least one of the unlocking, adjusting and locking devices and said means for controlling being responsive to said scanning element.

11. The wire card napping machine of claim 10, wherein the scanning element is a sensor.

12. A napping machine comprising:

a frame;

a cylinder having first and second ends rotatably supported in said frame and means for rotating said cylinder;

napping rollers of a first and a second type;

pick-up units, each for rotatably supporting at least two of said napping rollers between said first and second ends of said cylinder;

said pick-up units selectively supporting at least one of said at least two of said napping rollers in an inoperable position whereat said at least one napping roller is not engaging a cloth to be napped;

lock means, at each of said pick-up units, for locking said pick-up units to prevent rotation thereof;

unlocking means for selectively engaging said lock means to effect unlocking of said pick-up units;

rotation means for selectively engaging and rotating said pick-up units to selectively position one of said napping rollers of said first type and said napping rollers of said second type in said inoperable position; and means for controlling said unlocking and said rotation means to effect selection of said napping rollers.

* * * * *